United States Patent [19]

Fujino et al.

[11] Patent Number: 4,888,620

[45] Date of Patent: Dec. 19, 1989

[54] PROCESS CARTRIDGE AND IMAGE FORMING APPARATUS USING THE SAME

[75] Inventors: Hitoshi Fujino, Tokyo; Takamasa Sawada, Kawasaki; Hiroo Kobayashi, Tokyo; Osamu Ohuchi; Tadashi Yagi, both of Kawasaki; Yasuyoshi Hayakawa, Yokohama, all of Japan

[73] Assignee: Canon Kabushiki Kaisha, Tokyo, Japan

[21] Appl. No.: 323,074

[22] Filed: Mar. 9, 1989

Related U.S. Application Data

[63] Continuation of Ser. No. 241,777, Sep. 7, 1988, abandoned, which is a continuation of Ser. No. 3,462, Jan. 15, 1987, abandoned.

[30] Foreign Application Priority Data

| | | | |
|---|---|---|---|
| Jan. 17, 1986 | [JP] | Japan | 61-007676 |
| Jan. 23, 1986 | [JP] | Japan | 61-012778 |
| Jan. 24, 1986 | [JP] | Japan | 61-013090 |

[51] Int. Cl.[4] ..... G03G 5/00; G03G 15/06; G03G 21/00; G03G 15/048

[52] U.S. Cl. ..... 355/211; 355/260; 355/296

[58] Field of Search ..... 355/3 DR, 3 DD, 3 R, 355/211, 245, 260, 296

[56] References Cited

U.S. PATENT DOCUMENTS

| | | | |
|---|---|---|---|
| 4,076,402 | 2/1978 | Kanno et al. | 355/3 DR |
| 4,323,306 | 4/1982 | Ito et al. | 355/3 DD X |
| 4,462,677 | 7/1984 | Onoda | 355/3 DR X |
| 4,555,173 | 11/1985 | Iseki et al. | 355/3 R |
| 4,583,832 | 4/1986 | Kasamura et al. | 355/3 DD |
| 4,593,993 | 6/1986 | Imaizumi | 355/3 R |

FOREIGN PATENT DOCUMENTS

| | | | |
|---|---|---|---|
| 88243 | 7/1981 | Japan . | |
| 118454 | 8/1983 | Japan . | |
| 177371 | 9/1985 | Japan | 355/3 DD |
| 61-282876 | 12/1986 | Japan . | |

*Primary Examiner*—A. T. Grimley
*Assistant Examiner*—E. J. Pipala
*Attorney, Agent, or Firm*—Fitzpatrick, Cella, Harper & Scinto

[57] ABSTRACT

An image forming apparatus includes a main assembly and a process cartridge. The main assembly contains and retains an electrophotographic photosensitive member, and therefore, the photosensitive member is not contained in the process cartridge. The process cartridge contains an electric charger, a developing device and/or cleaning device. The process cartridge is detachably mountable into the main assembly.

17 Claims, 14 Drawing Sheets

PROCESS CARTRIDGE AND IMAGE FORMING APPARATUS USING THE SAME

This application is a continuation of application Serial No. 241,777, filed Sept. 7, 1988, now abandoned, which is a continuation of Serial No. 003,462, filed Jan. 15, 1987, now abandoned.

FIELD OF THE INVENTION AND RELATED ART

The present invention relates to a process cartridge containing process means usable with an image forming apparatus such as an electrophotographic copying machine, an electrostatic recording machine and a printer, and to an image forming apparatus usable with such a cartridge.

A process cartridge is known which contains as a unit a photosensitive member, a developing device, a cleaning device, a charger and the like in a casing and which is detachably mountable into the image forming apparatus, as disclosed in U.S. Pat. Nos. 4,462,677; 4,470,689; 4,500,195; 4,538,896; 4,540,268; 4,551,000; 4,566,777; 4,575,221; 4,588,280; 4,591,258; 4,598,993; 4,607,941; and 4,609,276 which have been assigned to the assignee of the present application. There are other U.S. Pat. Nos., namely, 3,966,316; 3,985,436; and 4,236,807, which disclose a process cartridge.

The service life of the process cartridge ends when the toner is consumed up in the developing device in the process cartridge, when the photosensitive drum is deteriorated, when the cleaning operation becomes not satisfactory or when the charger is so much contaminated as to produce non-usual discharging action or the like. When one or more of those occur, the entire cartridge is replaced with a fresh one, and therefore, the running cost is relatively high.

On the other hand, a photosensitive member having a long service life, such as A-Si (amorphous silicon) photosensitive member has recently been put into practice, and the service life thereof becomes close to that of the entire image forming apparatus.

SUMMARY OF THE INVENTION

The present invention is made noting the extended service life of the photosensitive member.

Accordingly, it is a principle object of the present invention to provide a process cartridge and an image forming apparatus using the same, suitable to the case where the photosensitive member having the extended service life is used.

It is another object of the present invention to provide a process cartridge and image forming apparatus using the same wherein the photosensitive member is not contained in the process cartridge but is contained in the image forming apparatus.

It is a further object of the present invention to provide a process cartridge and an image forming apparatus using the same wherein the photosensitive member is not damaged when the process cartridge is mounted into or demounted from the image forming apparatus.

It is a further object of the present invention to provide a process cartridge and an image forming apparatus using the same wherein the mounting and demounting operations are easy without damaging the photosensitive member utilizing movement during the mounting and demounting operations.

According to an embodiment of the present invention, there is provided a process cartridge detachably mountable into a main assembly of an image forming apparatus, comprising plural process means for forming an image on an image bearing member mounted in the main assembly, and supporting means for supporting said process means in said process cartridge, said supporting means supporting at least one of said process means for movement toward and away from said image bearing member when said process cartridge is mounted into or demounted from the main assembly.

Since the photosensitive drum is kept retained in the image forming apparatus, while other image forming process means are contained as a unit in the cartridge, the cartridge is replaced when the toner is consumed up or when another trouble occurs. Therefore, the running cost of the cartridge can be decreased.

The present invention is applicable to various machines such as an electrophotographic copying machine, an electrophotographic printer, an electrophotographic facsimile machine, other recording machine or the like.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
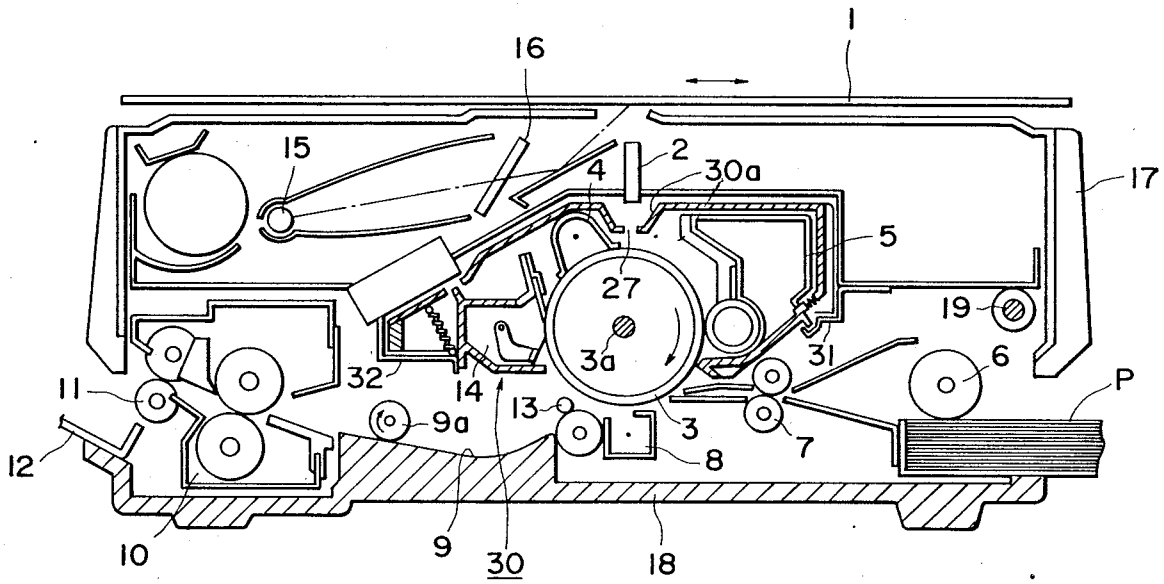
FIG. 1 is a sectional view of an image forming apparatus according to an embodiment of the present invention.
Figure 2:
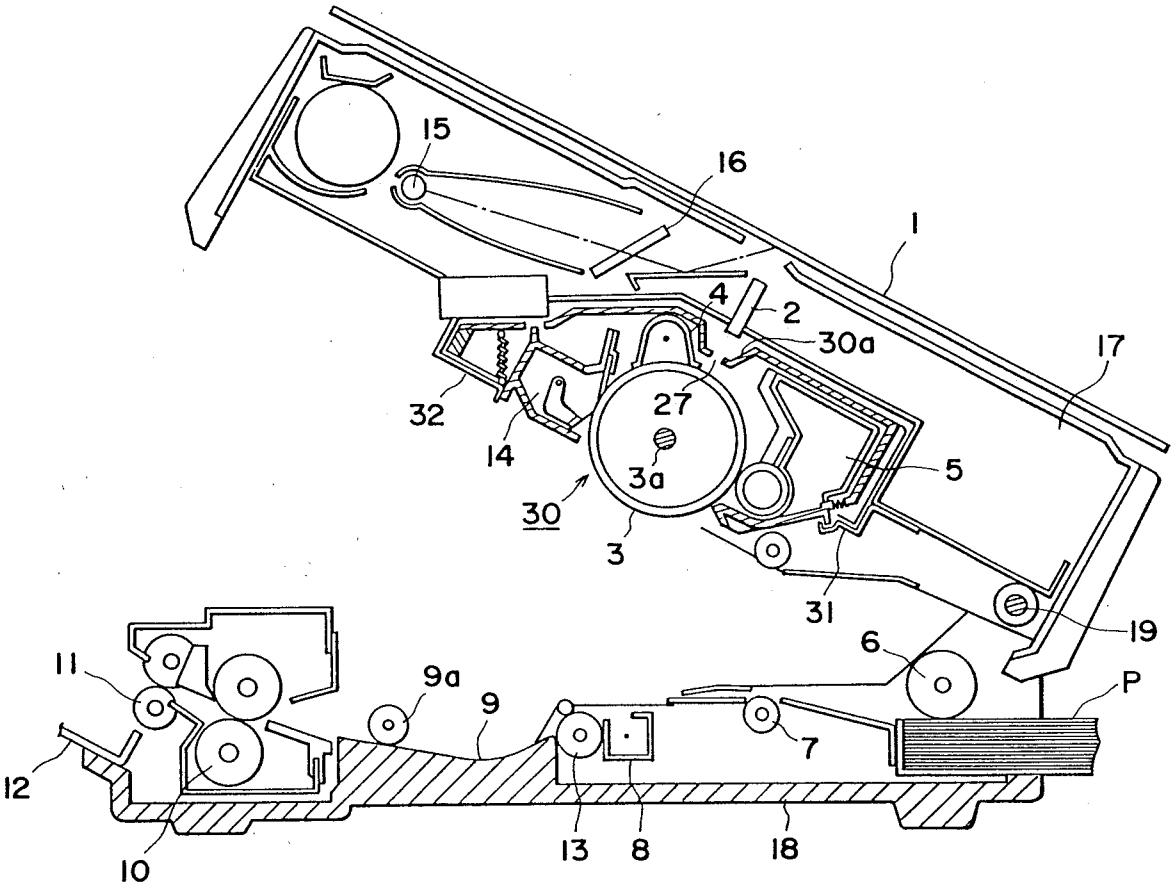
FIG. 2 is a sectional view of the same apparatus when the assembly upper thereof is opened.
Figure 3:
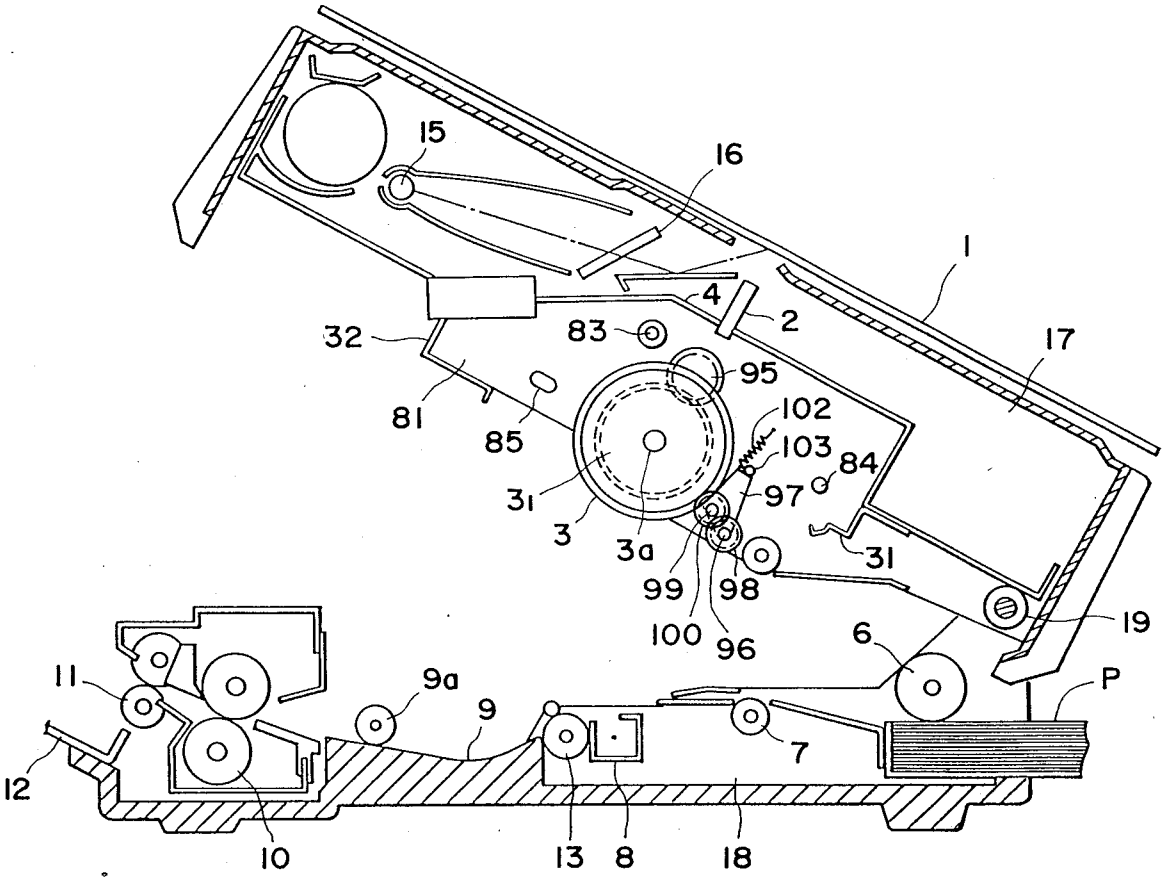
FIG. 3 is a sectional view of the same apparatus without the process cartridge.

Referring to FIGS. 1, 2 and 3, there is shown an electrophotographic copying machine as an example of an image forming apparatus according to an embodiment of the present invention.

In FIG. 1, an original to be copied is placed on an original supporting table 1 which is made of a transparent material and which is reciprocable in the direction of an arrow. A light image of the original on the original supporting table 1 is formed by an optical system including an array of imaging elements 2, and the light image is projected through a slit on a surface of an electrophotographic photosensitive member provided with an A-Si photosensitive layer in this embodiment. The photosensitive drum 3 is rotatable about a shaft 3*a* in the direction indicated by an arrow. A corona charger 4 serves to uniformly charge the surface of the photosensitive drum 3. The photosensitive drum 3, after being uniformly charged, is exposed to the above described light image so that an electrostatic latent image is formed. The thus formed electrostatic latent image is developed by a developing device 5 into a toner image.

On the other hand, a transfer sheet P for receiving the toner image is fed to the surface of the photosensitive drum 3 by a pick-up roller 6 and registration roller 7, and if the toner image on the photosensitive drum 3 is transferred onto the transfer sheet P by a transfer charger 8. Then, the sheet P is separated from the photosensitive drum 3 by a separation means 13 and is passed along a guide 9 by a roller 9*a* to an image fixing device 10, where the toner image on the sheet P is fixed into a permanent image. Subsequently, the sheet P is discharged onto the tray 12 by discharging rollers 11. The toner remained on the photosensitive drum 3 by not being transferred to the sheet P is removed by a cleaning device 14 from the photosensitive drum 3, the cleaning device 14 including a blade member.

The image forming machine further includes an illumination system for illuminating the original on the original supporting table 1 and a filter 16 such as a heat absorbing filter or the like.

The copying machine is divisible into an upper assembly 17 and a lower assembly 18 which are pivotable about a pivot pin 19. More particularly, the upper assembly 17 is pivoted upwardly about the pin 19.

The upper assembly contains the optical system 2, the illumination system 15, the photosensitive drum 3, the developing device 5, the cleaning device 14 or the like which are process means to be used in an image forming operation.

The lower assembly 18 contains the pick-up roller 6, transfer charger 8, the separating means 13, the guide 9, the fixing device 10 or the like which are arranged along a sheet transportation passage.

In this embodiment, the image formation process means excluding the photosensitive drum 3, namely, the developing device 5, the cleaning device 14, the charger 4 or the like are contained in a separate housing to constitute a process cartridge 30. The process cartridge 30 can be removed as a unit from the copying machine, and a fresh process cartridge can be mounted thereinto, thus facilitating the maintenance operation.

When the process cartridge 30 is mounted into or demounted from the copying machine (main assembly of the image forming apparatus), it is moved along rails 31 and 32 provided in the machine in the longitudinal direction of the photosensitive drum. It should be noted that the photosensitive drum 3 is retained in the upper assembly 17 irrespective of the mounting or demounting operation.

Figure 4:
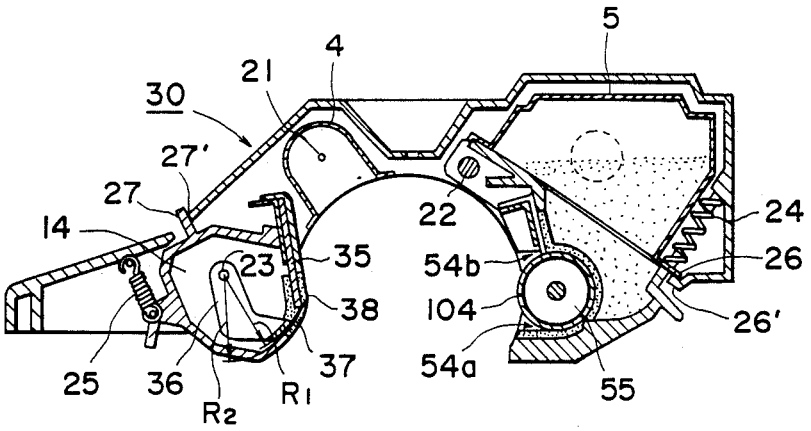
FIG. 4 is a cross sectional view of a process cartridge taken out of the image forming apparatus.

Referring to FIG. 4, the process cartridge 30 is shown in a cross section and in an enlarged scale. The process cartridge 30 is provided with four mechanisms, i.e., a mechanism for preventing damage to the photosensitive drum 3 during the mounting or demounting operation, a mechanism for preventing the toner powder from leaking out of the developing device and the cleaner during maintenance, mounting and demounting operations, a mechanism for positioning the process cartridge relative to the photosensitive drum and a mechanism for driving the developing device.

Because of the provisions of those mechanisms, the mounting and demounting of the process cartridge 30 can be carried out by users without difficulty and without toner scattering.

The detailed description will be made with respect to those mechanisms.

First, the mechanism will be explained which is effective to prevent the photosensitive drum 3 and the developing device, more particularly, a developing sleeve 104 from contacting to each other, the photosensitive drum 3 and the developing sleeve 104 being close when the process cartridge 30 is mounted into or demounted from the copying machine. The contact, if it occurs, can result in a nick of the sleeve 104 or the drum 3.

FIG. 4 illustrates the positions of various means in the process cartridge 30 when it is out of the copying machine. The developing device 5 is pivotably supported by a pin 22 and is urged by a compression spring 24 so that a portion 26 of the developing device is stopped by a stopper 26' of the process cartridge 30. The cleaning device 14 is also pivotably mounted by a pin 23 and is urged by a tension spring 25 so that a portion 27 of the cleaning device 14 is stopped by a stopper 27' which is an edge defining a slot of the process cartridge 30.

Figure 5A:
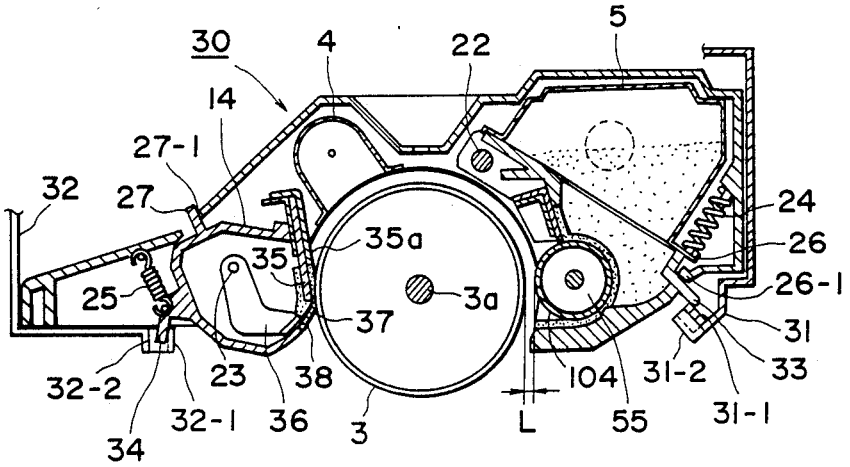
FIG. 5A is a sectional view of the apparatus in the process of the mounting operation of the process cartridge.
Figure 5B:
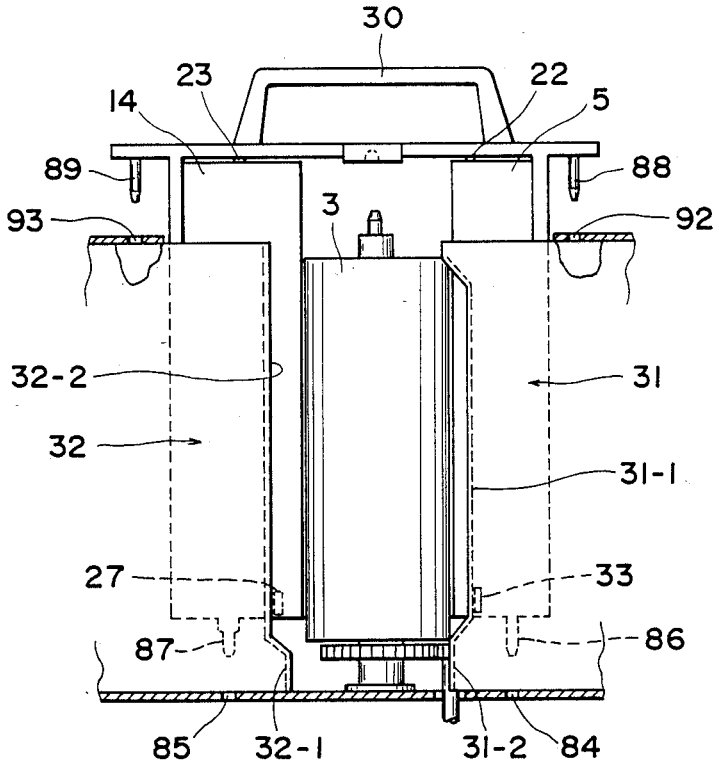
FIG. 5B is a bottom plan view of the process cartridge in the process of being mounted into the image forming apparatus.
Figure 8:
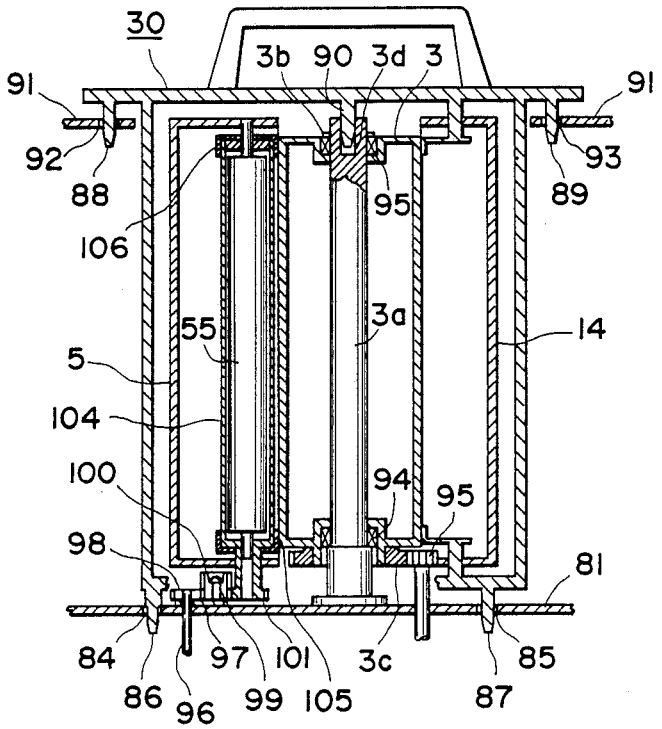
FIG. 8 is a longitudinal sectional view of the process cartridge of FIG. 7.

FIGS. 5A and 5B illustrate the positions of those devices while the process cartridge 30 is in the process of being mounted into the copying machine. When the process cartridge 30 is inserted into the copying machine along the right guide rail 31 and the left guide rail 32, a rib 33 of the developing device 5 is pushed by a developer guiding surface 31-1 of the right guide rail 31 so that the spring 24 is compressed. By this, the developing device 5 is pivoted about the pin 22 in the counterclockwise direction in this Figure to expand the central space of the process cartridge 30. Therefore, the distance L between the surfaces of the developing sleeve 104 and the photosensitive drum 3 is expanded. The expanded position is maintained from the start of the mounting operation to immediately before completion of the mounting operation. At the completion of the mounting, the rib 33 is released from the guiding surface 31-1. Then, as shown in FIG. 8, spacer rollers 105 and 106 fixed to the developing sleeve 104 at the opposite ends thereof are contacted to the surface of the photosensitive drum 3. By the contact, a predetermined clearance 1 (FIG. 6) is maintained between the surfaces of the photosensitive drum 3 and the developing sleeve 104.

On the contrary, the cleaning device 14 maintains its position shown in FIG. 4 or FIG. 5A until immediately before completion of the mounting operation. At the time of completion of the mounting, a releasing rib 34 of the cleaning device 14 is pushed by a cleaner guiding surface 32-2 of the left guide rail 32, so as to expand the tension spring 25, with the result that the cleaner 14 pivots about the pin 23 in the counterclockwise direction in this Figure. By this, the cleaning device 14 is set in position.

Figure 6:
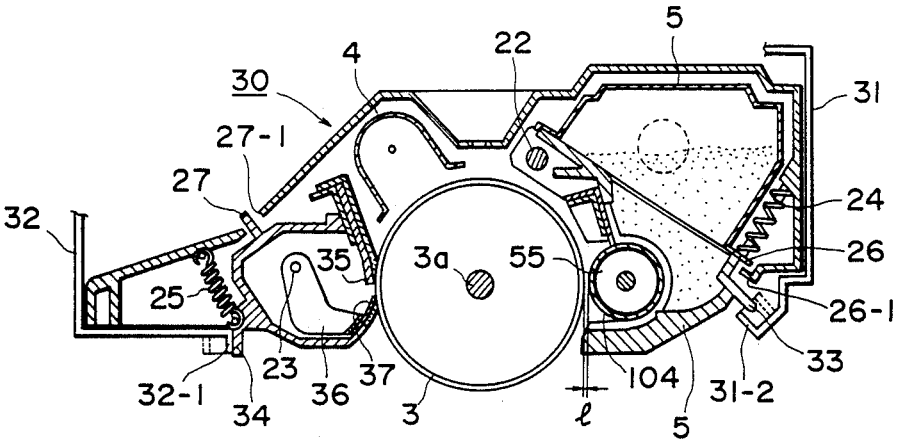
FIG. 6 is a sectional view of the process cartridge wherein it has been completely mounted into the apparatus.

As shown in FIG. 4 a cleaning blade 35 of elastic material is fixed to the cleaning device 14. On the contrary, a scooping or toner receiving sheet 37 of polyester resin is bonded to a sheet arm 36 which is fixed to a pin 23 which, in turn, is fixed to the process cartridge 30. Therefore, the sheet arm 36 and the sheet 37 do not rotate relative to the housing of the process cartridge 30. When the process cartridge 30 is out of the copying machine or is in the process of being mounted into the copying machine, the cleaning blade 35 is maintained in such a position that it is partly superimposed at the inside part of the sheet 37. However, at the time of the completion of the mounting operation, as shown in FIG. 6, the cleaning device 14 is shifted to the predetermined position, and simultaneously, the cleaning blade 35 slides on the inside of the sheet 37, and finally it press-contacts the surface of the photosensitive drum 3.

As shown in FIG. 4, the inside surface 14*a* of the cleaning device 14 slides relative to the sheet arm 36 through the sheet 37. The radius of curvature R1 of the inside surface 14*a* and the radius of curvature R2 of the outside surface of the sheet arm 36 about the fixed pin 23 are so determined that the opening of the cleaning device 14 can be effectively closed to prevent toner leakage. At the opposite longitudinal ends of the cleaning blade 35 and the scooping sheet 37, sealing members 38 of felt or moltplane or the like is bonded to the cleaning device 14.

As will be understood from the foregoing, the toner leakage from the process means (the developing device 5 and the cleaning device 14) is effectively prevented not only when the process cartridge 30 is out of the copying machine but also during the process of the process cartridge 30 being mounted into or demounted from the copying machine.

Figure 7:
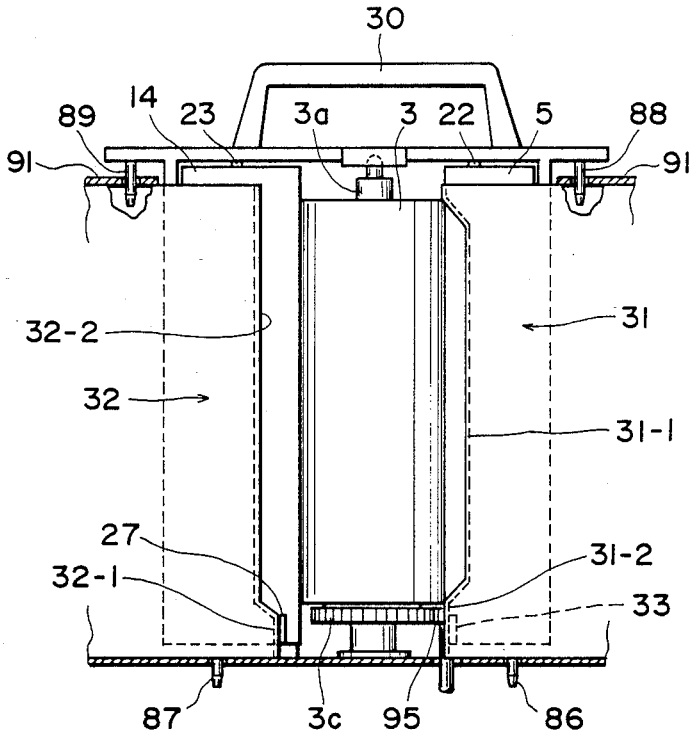
FIG. 7 is a top plan view of the apparatus when the process cartridge has been completely mounted into the apparatus.

Referring to FIGS. 7 and 8, the description will be made when the process cartridge 30 is completely mounted into the copying machine. FIG. 7 is a top plan view of the machine when the process cartridge 30 is positioned in place. FIG. 8 is a longitudinal sectional view.

The description will be made with respect to a mechanism for positioning the process cartridge 30 relative to the front plate of the upper assembly 17 of the copying machine and also relative to the center of the photosensitive drum 3.

The rear wall of the process cartridge 30 is provided with two, in this embodiment, positioning pins 86 and 87 for positioning the process cartridge 30 relative to the rear plate 81 of the copying machine. The front wall of the process cartridge 30 is provided with pins 88 and 89, which are positioned into positioning holes 92 and 93 formed in the front wall 91 of the machine. Additionally, the process cartridge 30 is provided with a pin 90 for positioning it relative to the central shaft 3*a* of the photosensitive drum 3 (FIG. 8).

As will be understood, the photosensitive drum 3 is cantilevered at its rear side to the upper assembly, but when the process cartridge 30 is mounted in position in the machine, the positioning pin 90 is engaged into the recess 3*d* formed in the end surface of the shaft 3*a* of the photosensitive drum 3, and therefore, the photosensitive drum 3 is supported at the opposite sides thereof. Simultaneously, the process means, namely, the developing device 5, the cleaning device 14 and charger (not shown in FIG. 7) constituting the process cartridge 30, are set in position relative to the photosensitive drum 3.

Referring to FIGS. 7 and 8, the description will be made with respect to the driving system for the photosensitive drum 3 and the developing sleeve 104 which is in the process cartridge 30. The drum shaft 3*a* is fixed to the main assembly 81 of the machine. The photosensitive drum 3 is rotatably supported on the drum shaft 3*a* adjacent the opposite ends of the drum shaft 3*a* by bearing members 94 and 95. A ring 3*b* is fixed to the drum shaft 3*a* to function as a thrust bearing for the photosensitive drum 3 (FIG. 8).

To the rear end of the photosensitive drum 3, a small diameter gear 3*c* is fixed and is meshed with a driving gear 95 of the main assembly of the copying machine. Upon instruction signal for drive start, a driving system (not shown) of the main assembly drives the driving gear 95, and therefore, the photosensitive drum 3 is rotated through the gear 3*c*.

The main assembly is provided with a shaft 96 projected into the inside thereof. The shaft 96 is provided with a swingable arm 97 which is pivotable about the shaft 96, and the shaft 96 has a gear 98 fixed thereto (FIG. 8 and FIG. 3).

To an end of the arm 97, a gear 100 is mounted by a shaft 99. The gear 100 is meshed with the gear 98 and a gear 101 which is fixed to a rear side end of the developing sleeve 104. The arm 97 is urged upwardly by the spring 102 and stopped by a stopper 103 projected from the main assembly.

When the process cartridge is inserted into the main assembly of the copying machine, the developing sleeve 104 is relatively away from the photosensitive drum 3 until immediately before the completion of the insertion, as described hereinbefore, so that the sleeve gear 101 and the driving gear 100 are not meshed although they are opposed. However, upon completion of the insertion, they are meshed.

At the time of the meshing engagement, even if the teeth of the gears abut each other, the arm 97 is pivoted counterclockwisely about the shaft 96 by pushing the developing unit so as to prevent the pressure contact of the teeth. Upon copy start instructing signal, the shaft 96, and therefore, the gear 98, start to rotate. Then, the gear is moved upwardly by the spring 102 to establish the meshing engagement between the driving gear 100 and the developing sleeve gear 101, so as to rotate the developing sleeve 104.

Referring to FIGS. 9–13, another example of means is shown for preventing the damage to the photosensitive drum when the process cartridge 30 is mounted into or demounted from the main assembly.

Figure 9:
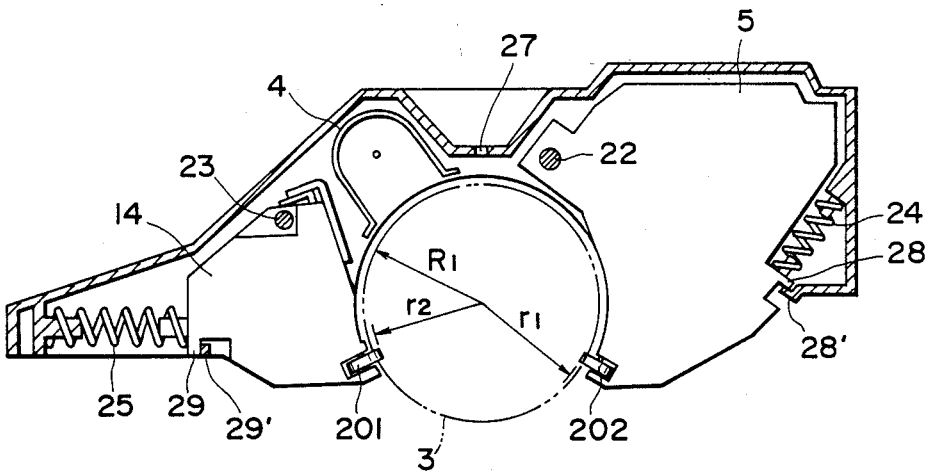
FIG. 9 is an enlarged cross-sectional view of the process cartridge according to a second embodiment of present the invention.
Figure 10:
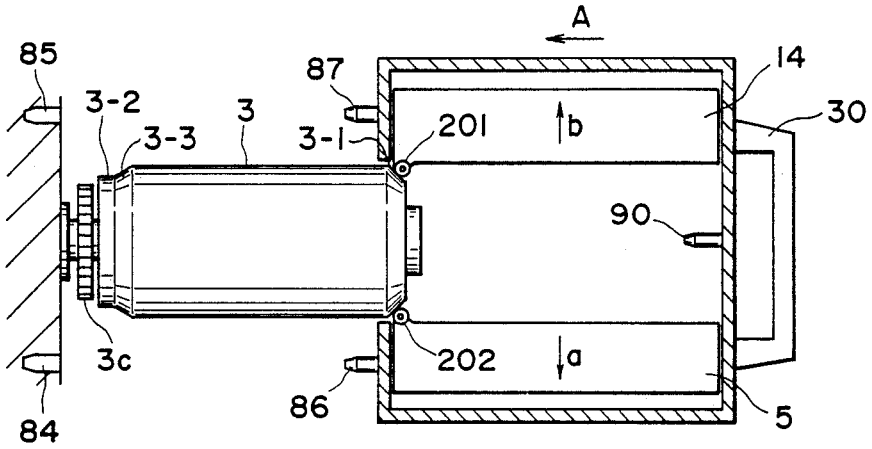
FIG. 10 is a partly sectional top elevation of the process cartridge of FIG. 9 when the mounting operation starts.

As shown in FIGS. 9 and 10, the process cartridge 30 is provided with rotatable rollers 202. The peripheral movement of each of the rollers is codirectional with the drum shaft. The distance r1 between the center of the photosensitive drum 3 and the point of the roller 202 periphery which is closest to the center is so determined relative to the radius R of the photosensitive drum 3 that the following is satisfied:

$$r1 \leqq R$$

The roller 202 is rotatably supported to the developing device.

The cleaning device 14 is swingably mounted by a pin 23, similarly to the developing device 5, and is urged by a compression spring 25 so that the portion 29 thereof is stopped by a stopper 29'. The cleaning device 14 is provided with a rotatable roller 201, similarly to the case of the developing device 5. The distance r2 between the center of the photosensitive drum 3 and a point of a surface of the roller 201 closest to the center, is so determined relative to the radius R of the photosensitive drum 3 that the following is satisfied:

$$r2 \leqq R$$

Figure 11:
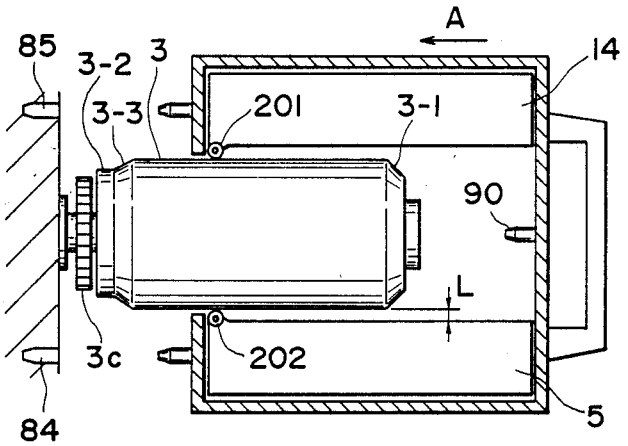
FIG. 11 is the same elevation in the process of the process cartridge being mounted into the apparatus.
Figure 12:
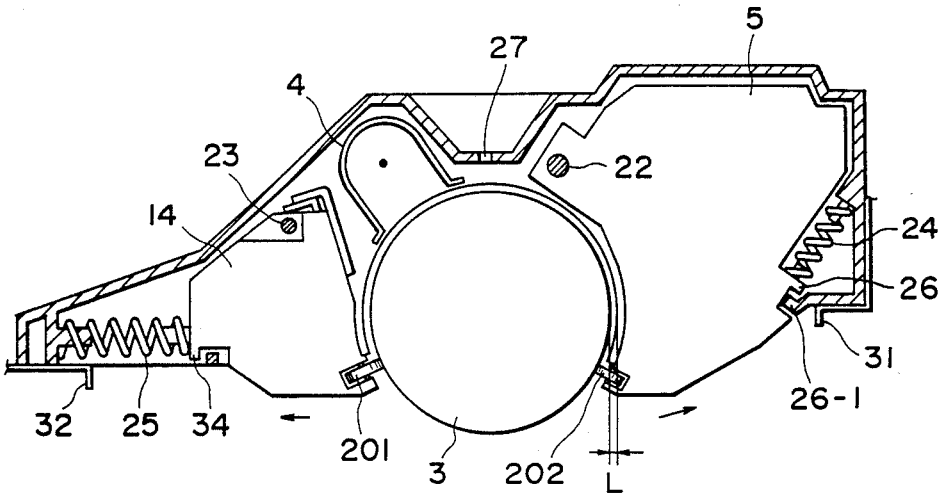
FIG. 12 is an enlarged cross-sectional view of the process cartridge which is being mounted into the apparatus.

As will be understood from FIG. 11, the rollers 201 and 202 are disposed at such a position that when the process cartridge 30 is mounted into the main assembly, they are contacted to the photosensitive drum 3 prior to the developing device 5 and the cleaner 14 or the other portion being contacted to the photosensitive drum 3.

FIGS. 10 and 11 illustrate the states wherein the process cartridge 30 is being inserted into the main assembly in the direction of an arrow A.

Figure 13:
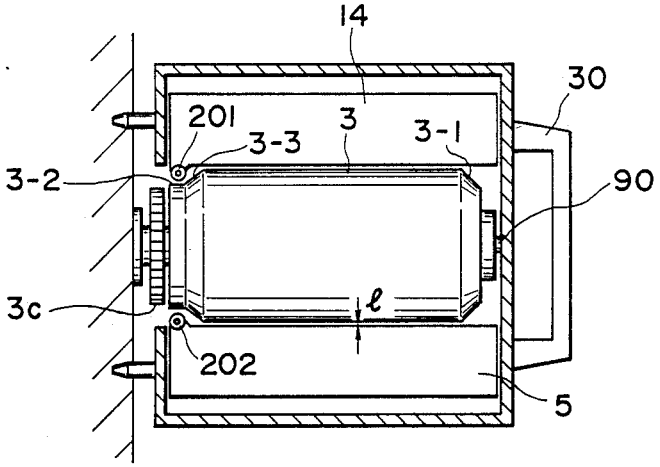
FIG. 13 is a plan view of the process cartridge which has completely been set in the apparatus.

FIG. 13 is an enlarged cross sectional view of the process cartridge 30 at this time.

At the initial stage of the inserting operation, the rollers 201 and 202 are contacted to an inclined surface 3-1 of the photosensitive drum (FIG. 10). By this contact the developing device 5 is moved in a direction of an arrow a about a fixed pin 22, whereby the distance between the surfaces of the photosensitive drum 3 and the sleeve 104 is expanded. This state continues until immediately before the completion of the cartridge insertion. When the inserting operation is completing, the rollers 201 and 202 are contacted to another inclined surface 3-3 of the photosensitive drum 3 at the opposite end thereof and are received by an extension flange 3-2. By this, the stopper 28 of the developing device 5 engages to the stopper 28' of the cartridge 30, and therefore, the distance between the photosensitive drum 3 and the sleeve 104 is set to a predetermined distance.

Similarly to the developing device 5, the cleaning device 14 is shifted so as to be spaced further away from the surface of the photosensitive drum 3 during the inserting operation, and upon completion of the inserting operation, it is set in position.

Because of the above described construction, a larger clearance is formed between the photosensitive drum 3 and the developing device 5 and between the photosensitive drum 3 and the cleaning device 14 during the mounting or demounting operation of the process cartridge without the guide rails employed in the main assembly shown in FIGS. 1–8, so that a simpler structure is achieved.

FIGS. 14–19 illustrate another example of the mechanism for closing the opening of the cleaning device 14. The mechanism includes a shutter 110 which is supported by an arm 112. The arm 112 is pivotable about a pin 113 fixed to the cartridge 30.

Figure 14:
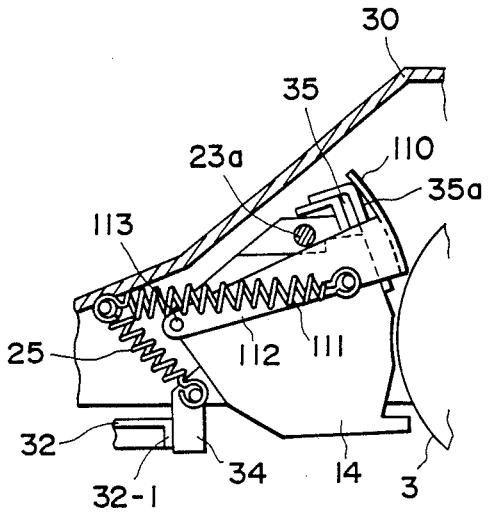
FIG. 14 is a side view of another example of a cleaner closing mechanism.
Figure 15:
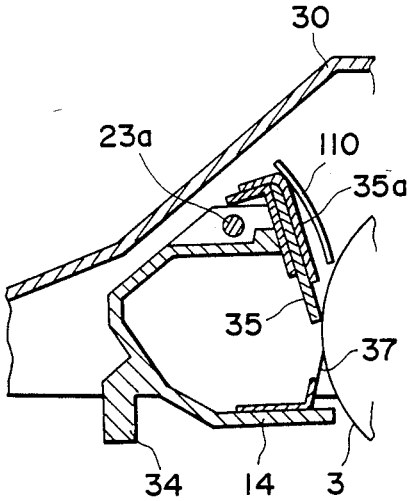
FIG. 15 is a longitudinal sectional view of the mechanism of 14.

Similarly to the embodiment of FIGS. 5A, B, 7 and 8, when the process cartridge 30 is inserted in the upper assembly 17, the shutter 110 and the arm 12 are urged upwardly about the pin 113*a* by a spring 11, and therefore, as shown in FIGS. 14 and 15, the cleaning device 14 is opened to the photosensitive drum 3.

Figure 16:
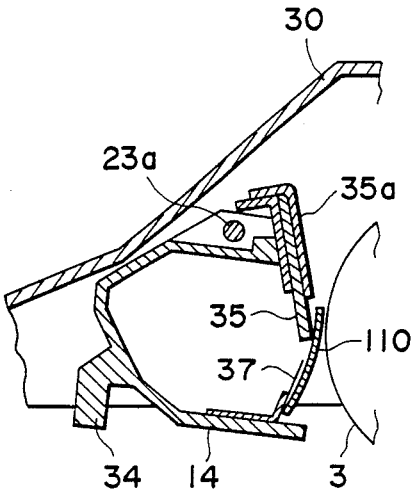
FIG. 16 a side view when the process cartridge is removed from the image forming apparatus.
Figure 17:
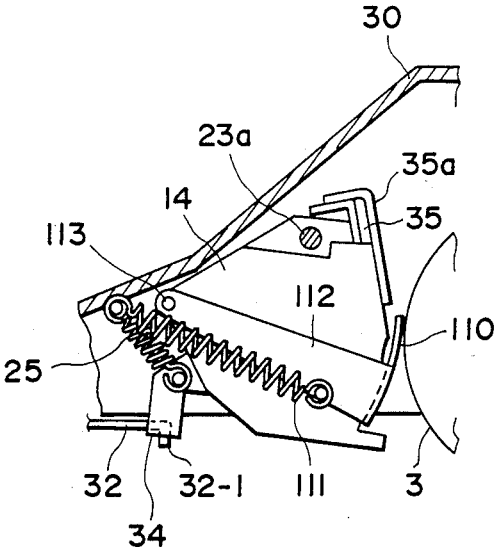
FIG. 17 is a longitudinal sectional view of the mechanisms shown in FIG. 16.

When the process cartridge 30 is slightly withdrawn, the, association between the elements 34 and 32-1 in a similar manner to the previous embodiment is released, and the cleaning device 14 rotates clockwisely about the pin 23*a* by the spring 25 to restore the position wherein it abuts the stopper 28*a*. Together with the rotation of the cleaning device 14, the pin 113 at the rotational center of the shutter 110 moves. When the position of the pin 113 moves beyond the operating line of the spring 111 pulling the shutter supporting arm 112, the shutter 110 is pulled downwardly by the spring 111 so as to close the opening of the cleaning device 14 adjacent the blade 35 and the sheet 37, as shown in FIGS. 16 and 18.

Figure 18:
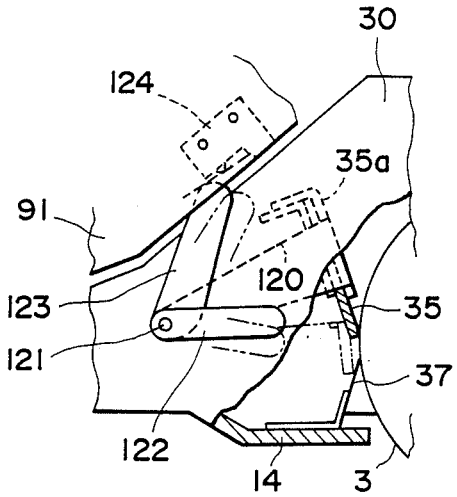
FIG. 18 is a side view of a closing mechanism according to another embodiment of the present invention.
Figure 19:
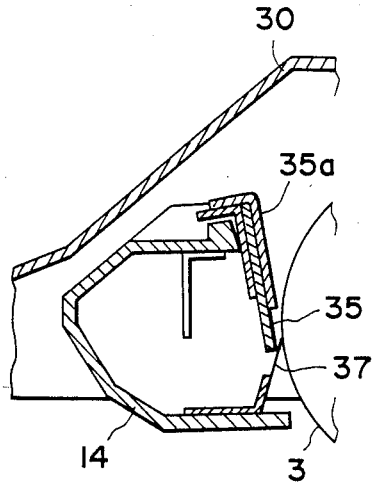
FIG. 19 is a cross-sectional view of the same mechanism.

FIGS. 18 and 19 illustrate a further embodiment.

As contrasted to the foregoing embodiments, the main body of the cleaning device 14 is fixed to the cartridge 30. A blade 35 is supported on an arm 120 through a holder 35*a*. In this embodiment, the opening is formed between the sheet 37 and the blade 35 as shown in FIG. 18, by pivoting the arm 120 and the blade 35 about a pin 121 on the cleaning device 14. The opening is closed by superimposing the blade 35 itself and the sheet 37 as shown in FIG. 19 by pivoting downwardly the blade 35.

The pivoting operation of the blade 35 is performed by an operating lever 122 mounted to the pin 121, the lever 122 being projected outside the cartridge 30. An arm 123 is mounted so that it moves together with the operating lever 122. When the cartridge 30 is set in place in the upper assembly 17, the arm 123 projects behind a part of a rear plate 91 of the upper assembly so as to prevent the cartridge 30 from being retracted. Simultaneously, the arm 123 is effective to actuate a microswitch 124 mounted to the rear plate. The closed state of the microswitch 124 is transmitted to a controlling system of the main assembly so as to enable the printing or copying operation.

When the lever 122 and the arm 123 are rotated clockwisely to a position shown by chain lines in FIG. 18, the state of FIG. 19 is established so that the blade 35 and the sheet 37 are superimposed so as to close the opening, thus preventing the toner leakage. Simultaneously, the arm 123 is disengaged from the rear plate 91, with the result that the cartridge 30 can be removed from the upper assembly 17. Further, the microswitch 124 is deactivated, with the result that the printing or copying operation is disabled. In place of the microswitch 124, another means such as a photoelectric sensor may be used.

The lever 122 may be manually operated when the cartridge 30 is mounted or demounted, but an interrelated member may be employed such as a cam for raising the lever 122 at the end of the inserting operation of the cartridge 30 into the upper assembly 17, so that the opening of the cleaning device 14 at the side to be opposed to the photosensitive drum 3 is closed or opened in association with mounting and demounting of the cartridge 30.

In this embodiment, if the cartridge 30 contains only the cleaning device 14, then guide rails 32 and 31 may be provided in the process cartridge 30, the upper assembly 17 or the main assembly of the copying machine to perform the same function as described above.

Figure 20:
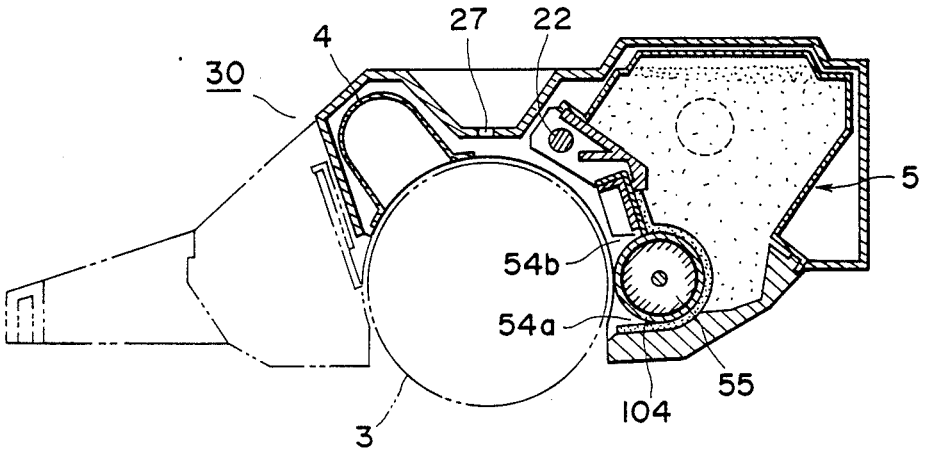
FIGS. 20, 21 and 22 illustrate examples of various combinations of the process means contained the process cartridge.

FIG. 20 illustrates another embodiment, wherein the photosensitive drum 3 and the cleaning device 14 are retained in the main assembly of the image forming apparatus, whereas the process cartridge contains the developing device 5 and the charger 4 as the process means.

If the toner containing capacity of the cleaning device 14 is large enough, the exchanging period of the cleaning device 14 is longer than that of the cartridge, and therefore, the cleaning device 14 may be retained in the main assembly.

In this embodiment, it is not necessary to shift the cleaning device 14 away from the photosensitive drum 3 when the process cartridge 30 is mounted into or demounted from the main assembly. Therefore, the toner scattering from the cleaning device 14 does not occur, and therefore, the relatively complicated mechanism for preventing the toner scattering becomes unnecessary.

Additionally, since the cleaning device is not shifted away from the photosensitive drum, the surface of the drum is continuously cleaned. Therefore, in the case where a process cartridge 30 containing a developer for different color toner is mounted, and the printing or copying operation is effected with this developing device, there is no possibility that different color toners are mixed since the cleaning device 14 is kept in contact with photosensitive drum 3.

Figure 21:
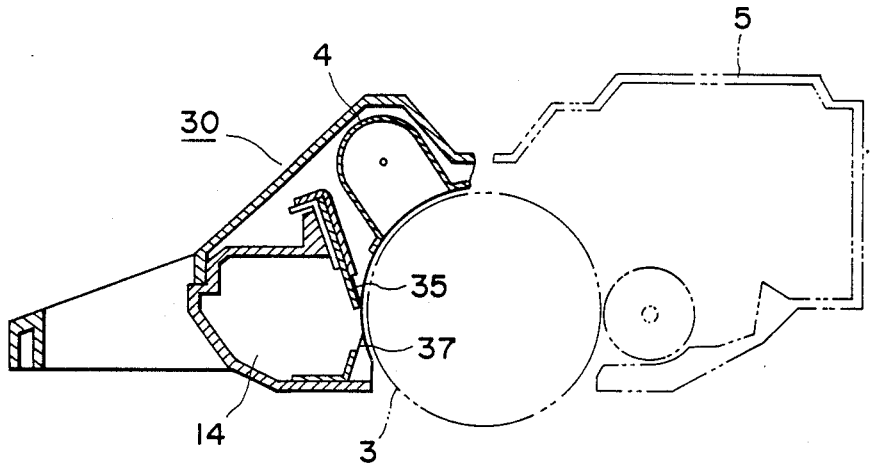

FIG. 21 illustrates a further embodiment wherein the photosensitive drum 3 and the developing device 5 are retained in the main assembly of the image forming apparatus, whereas the cleaning device 14 and the charger 4 are contained as the process means in the process cartridge.

Generally, the developing device 5 is complicated in structure, and therefore, is expensive and relatively bulky. If the toner containing capacity of the developing device 5 is increased enough or if the toner can be supplied into the developing device 5, the exchanging period of the developing device 5 can be made longer than the other part of the cartridge. Therefore, the developing device 5 may be retained in the main assembly, so that the process cartridge is made small in size and inexpensive, as shown in FIG. 10.

Figure 22:
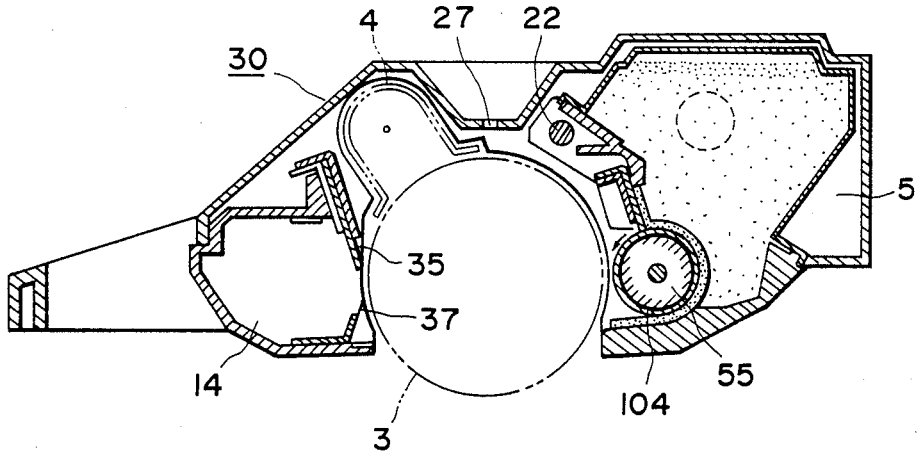

FIG. 22 illustrates another embodiment wherein the photosensitive drum 3 and the charger 4 are retained in the main assembly, whereas the cleaning device 14 and the developing device 5 are contained in the process cartridge as the process means.

The charger 4, as contrasted to the cleaning device 14 and the developing device 5, may be retained in the main assembly as one of substantially permanently durable elements if it is serviced properly by cleaning or exchange of the wire. Generally, the charging wire of the charger 4 is contaminated by the toner, and therefore, the period between the required cleaning operations is not always equal to the period of the cartridge exchange. From this point of view, it is effective that the charger 4 is retained in the main assembly on the condition that the wire thereof is cleaned at proper intervals. The detailed explanation of this embodiment will be omitted since the developing device is similar to that shown in FIG. 20, and since the cleaning device is similar to that shown in FIG. 21.

The direction of the mounting or demounting of the process cartridge is not limited to the direction of the generator line of the photosensitive drum 3, but may be the cumferential direction of the photosensitive drum 3.

The photosensitive member has been described as being in the form of a drum, but may be in the form of a belt trained around plural rotatable rollers. The process means contained in the process cartridge is not limited to the charger, the developing device and the cleaning device, but may comprise a transfer charger, an electrical discharging lamp, a discharger between the developing station and the image transfer station and/or a discharger upstream of the cleaning device.

As described in the foregoing, according to the present invention, the photosensitive member and the process means can be exchanged independently from each other, in accordance with the respective service lives. Upon the exchanging operation, the process means in the process cartridge is shifted toward and away from the photosensitive member in interrelation with the exchanging operation, so that the process means can be positioned correctly in place without the necessity of specific adjustment. Further, since the opening of the cleaning device can be closed at proper time, the toner is not unintentionally leaked out. Additionally, by the interrelation between the cartridge mounting or demounting operation and the operation of the opening, the possible toner scattering in the exchanging operation can be positively prevented.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable into a main assembly of an image forming apparatus, comprising:

plural process means for forming an image on a drum-shaped image bearing member mounted for rotation about a rotational axis in the main assembly; and supporting means for supporting said process means in said process cartridge, said supporting means supporting at least one of said process means for movement toward and away from said image bearing member, interrelatedly with mounting and demounting of said cartridge, when said process cartridge is mounted into or demounted from the main assembly;

wherein when said process cartridge is mounted into or demounted from said main assembly, said process cartridge is moved in a direction of the rotational axis of the image bearing member, and wherein said at least one of said process means is moved toward and away from the image bearing member by contacting a part of said process cartridge and a surface of the image bearing member.

2. A process according to claim 1, wherein said part of said process cartridge is integral with said at least one of said process means.

3. A process cartridge according to claim 1, wherein said part of said process cartridge includes a rotatable member mounted to said at least one of said process means.

4. A process cartridge according to claim 1 wherein said process cartridge includes cleaning means as said process means, said cleaning means is provided with an opening which is opened or closed in association with the mounting and demounting of said process cartridge.

5. A process cartridge according to claim 4, wherein the opening and closing of said cleaning means is effected by cooperation between a cleaning blade and a toner receiving sheet of said cleaning means, the toner receiving sheet being disposed upstream of the cleaning blade with respect to movement of a surface of the image bearing member.

6. A process cartridge according to claim 4, wherein the opening and closing of said cleaning means is effected by movement of a cover which is movable between a first position for closing the opening and a second position for uncovering the opening.

7. An image forming apparatus, comprising:

a main assembly containing an image bearing member rotatable about a rotational axis;

a process cartridge detachably mountable in a direction of the rotational axis of said image bearing member into said main assembly of said image forming apparatus, including plural process means for forming an image on said image bearing member mounted in said main assembly and first supporting means for supporting said process means in said process cartridge, said first supporting means supporting at least one of said process means for movement toward and away from said image bearing member, interrelatedly with mounting and dismounting of said cartridge, when said process cartridge is mounted into or demounted from the main assembly, said at least one process means being movable by contact between the surface of the image bearing member and a part of said process cartridge;

second supporting means for supporting said process cartridge in said main assembly; and image forming means contained in said main assembly for forming the image on said image bearing member.

8. An apparatus according to claim 7, wherein said image forming means in said main assembly includes optical means for forming an image on said image bearing member and means for feeding a sheet for receiving the image.

9. An apparatus according to claim 7, wherein said image forming means contained in said main assembly includes optical means for forming an image on said image bearing member, means for feeding a sheet for receiving the image, means for transferring the image from said image bearing member to the sheet and means for fixing the image on the sheet.

10. An apparatus according to claim 7, wherein said process means contained in said cartridge includes cleaning means provided with an opening, said cleaning means including means for closing and uncovering the opening in interrelation with mounting and demounting of said process cartridge.

11. An apparatus according to claim 10, wherein said opening and closing means includes a blade member for removing toner from said image bearing member and a toner receiving sheet.

12. An apparatus according to claim 10, wherein said closing and uncovering member includes a cover movable between a first position for closing the opening and a second position for uncovering the opening.

13. An image forming apparatus, comprising:

a main assembly containing an image bearing drum rotatable about a rotational axis;

a process cartridge detachable mountable into said main assembly of the image forming apparatus, including:

plural process means for forming an image on said image bearing member mounted in said main assembly; and first supporting means for supporting said process means in said process cartridge, said first supporting means supporting at least one of said process means for movement toward and away from said image bearing member when said process cartridge is mounted into or demounted from said main assembly;

second support means for supporting said process cartridge in said main assembly; and means contained in said main assembly for forming the image on said image bearing member;

wherein said process cartridge is moved in a direction of the rotational axis of said image bearing member, wherein said at least one of said process means in said cartridge is moved toward and away from said image bearing member interrelatedly with mounting and demounting of said process cartridge, and wherein said at least one process means is movable by contact between the surface of the image bearing member and a part of said process cartridge.

14. An apparatus according to claim 13, wherein said at least one of said process means is moved toward and away from said image bearing member by cooperation between a part of said main assembly and a member of said process cartridge.

15. An apparatus according to claim 14, wherein said member of said process cartridge is integral with said at least one of said process means.

16. An apparatus according to claim 14, wherein the part of the main assembly is a guide having a projection.

17. An image forming apparatus comprising:

a main assembly containing an image bearing drum;

a process cartridge detachably mountable into said main assembly of the image forming apparatus including:

plural process means for forming an image on said image bearing member mounted in said main assembly;

first supporting means for supporting said process means in said process cartridge, said first supporting means supporting at least one of said process means for movement toward and away from said image bearing member when said process cartridge is mounted into or demounted from said main assembly by cooperation between a part of said main assembly and a part of said process cartridge;

second support means for supporting said process cartridge in said main assembly; and means contained in said main assembly for forming the image on said image bearing member;

wherein said part of said main assembly is a peripheral surface of said image bearing member, and wherein said part of said process cartridge is moved along said surface to move said at least one process means toward and away from said image bearing member, said at least one process means being movable by contact between the surface of the image bearing member and a part of said process cartridge.

* * * * *

UNITED STATES PATENT AND TRADEMARK OFFICE

CERTIFICATE OF CORRECTION

PATENT NO. : 4,888,620

DATED : December 19, 1989

INVENTOR(S) : HITOSHI FUJINO, ET AL.

It is certified that error appears in the above-identified patent and that said Letters Patent is hereby corrected as shown below:

COLUMN 2

Line 35, "assembly upper" should read --upper assembly--.
Line 56, "present the" should read --the present--.

COLUMN 3

Line 2, "of 14." should read --of FIG. 14.--.
Line 12, "contained" should read --contained in--.
Line 44, "ger 8. Then," should read --ger 8, then,--.

COLUMN 5

Line 46, "is bonded" should read --are bonded--.

COLUMN 8

Line 5, "arm 12" should read --arm 112--.
Line 6, "spring 11," should read --spring 111,--.
Line 10, "the," should read --the--.

COLUMN 10

Line 6, "cumferential" should read --circumferential--.
Line 62, "process" should read --process cartridge--.

COLUMN 11

Line 1, "claim 1" should read --claim 1,--.

UNITED STATES PATENT AND TRADEMARK OFFICE

CERTIFICATE OF CORRECTION

PATENT NO. : 4,888,620

DATED : December 19, 1989

INVENTOR(S) : HITOSHI FUJINO, ET AL.

It is certified that error appears in the above-identified patent and that said Letters Patent is hereby corrected as shown below:

COLUMN 12

Line 4, "detachable" should read --detachably--.

Signed and Sealed this

Thirty-first Day of March, 1992

*Attest:*

*Attesting Officer*

HARRY F. MANBECK, JR.

*Commissioner of Patents and Trademarks*